US005810701A

United States Patent [19]

Ellis et al.

[11] Patent Number: 5,810,701

[45] Date of Patent: Sep. 22, 1998

[54] MOTION TRANSLATION ARRANGEMENT FOR EXERCISE MACHINE

[75] Inventors: Patrick D. Ellis, Oak Creek; Fred A. Malicki, Wauwatosa, both of Wis.

[73] Assignee: Northland Industries, Inc., South Milwaukee, Wis.

[21] Appl. No.: 877,290

[22] Filed: Jun. 17, 1997

[51] Int. Cl.[6] ..... A63B 21/06

[52] U.S. Cl. ..... 482/136; 482/97; 482/137; 482/139

[58] Field of Search ..... 482/137, 136, 482/135, 138, 133, 97, 94, 93, 92, 45, 44, 139, 101, 72, 100; 601/33, 24, 23

[56] References Cited

U.S. PATENT DOCUMENTS

| | | | |
|---|---|---|---|
| 3,759,512 | 9/1973 | Yount et al. | 482/138 |
| 4,465,274 | 8/1984 | Davenport | 482/138 |
| 4,629,185 | 12/1986 | Amann | 482/115 |
| 4,730,829 | 3/1988 | Carlson | 482/137 |
| 4,872,668 | 10/1989 | McGillis et al. | 482/113 |
| 4,949,951 | 8/1990 | Deola | 482/138 |
| 5,044,631 | 9/1991 | Jones . | |
| 5,181,896 | 1/1993 | Jones . | |
| 5,209,715 | 5/1993 | Walker et al. | 482/137 |
| 5,336,148 | 8/1994 | Ish, III | 482/137 |
| 5,356,353 | 10/1994 | Takaoka | 482/9 |
| 5,413,546 | 5/1995 | Basile | 482/137 |
| 5,437,589 | 8/1995 | Habing | 482/136 |
| 5,486,150 | 1/1996 | Randolph | 482/137 |
| 5,554,089 | 9/1996 | Jones . | |
| 5,562,577 | 10/1996 | Nichols, Sr. et al. . | |
| 5,580,341 | 12/1996 | Simonson . | |
| 5,667,464 | 9/1997 | Simonson | 482/137 |

OTHER PUBLICATIONS

Cybex Strength Systems, brochure, May 1995.

*Primary Examiner*—Richard J. Apley
*Assistant Examiner*—Victor K. Hwang
*Attorney, Agent, or Firm*—Andrus, Sceales, Starke & Sawall

[57] ABSTRACT

The invention relates to a shoulder press machine having a seat, a backrest and fixed framework at the top of which a carriage is mounted. The carriage has a pair of downwardly and forwardly extending, diverging lever arms which are tied together and moved upwardly and downwardly along a major horizontal axis mounted to the framework behind the backrest and a minor horizontal axis offset behind and parallel to the major horizontal axis. As the lever arms are moved together upwardly, they are simultaneously swung inwardly about a pair of parallel, angular pivot axes, the swinging motion being transferred via a pair of transfer links to pivot a pair of sleeves about the minor horizontal axis. As a result of these linkages, a shoulder press machine is provided in which an exerciser's hands rotate or supinate naturally through approximately 20°–30° as the lever arms are pushed upwardly. The inventive machine much more easily accommodates the natural musculoskeletal make-up of the human body without stress to the shoulder joints.

21 Claims, 7 Drawing Sheets

MOTION TRANSLATION ARRANGEMENT FOR EXERCISE MACHINE

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE INVENTION

This invention relates broadly to an exercise machine and, more particularly, pertains to a motion translation arrangement which maximizes the muscular benefits of an exercise motion while minimizing stress to joints and skeletal structure associated with the muscle group being exercised.

As is well known, many types of exercise machines have been designed to develop or rehabilitate specific muscle groups of the human body. Most of these machines have one or more operating levers or other instruments to be engaged by one while performing desired exercises. The operating levers are generally disposed in the machine to follow a prescribed exercise path. The exerciser is therefore induced to move his or her body according to the particular structure of the machine.

Machines of this variety offer a certain amount of exercise control in direct contrast to the use of free weights still preferred by many exercisers. Exercise movements with free weights are not constrained to follow predetermined planes of motion or prescribed angles. On the other hand, besides being generally safer than free weights, exercise machines address the various "sticking points" experienced in motions with free weights and have attempted to match a resistance variation throughout an entire range of motion with the natural strength curve of a particular muscle group. Although this controlled movement is generally desirable in order to isolate or associate an exercise with particular muscles or muscle groups, the mechanical design of the prior art exercise machines often defines a motion which is incompatible with the musculoskeletal make-up of the body.

This is particularly true in exercising muscles of the upper torso which commonly involve the shoulder, wrist and elbow joints. Because the shoulder joint, in particular, is subject to flexion, extension, abduction, adduction, rotation and combinations of these movements, it is extremely important that the use of the exercise machine will not cause the shoulder joint to be subjected to unnatural movements over the range of movement of the joint.

In the prior art, various machines have been proposed which exercise the muscles of the upper torso. One type of apparatus employs pivotable arms with handles connected to the bottoms of the arms, each handle adapted to be grasped by a person supported on a seat and pressed forwardly and upwardly in an arcuate path along a vertical plane converging inwardly with respect to the front of the seat. Such apparatus claims to accommodate the natural musculoskeletal movements of the arms and shoulders of a person. Another apparatus is provided with a hinge mechanism which allows a user to select a path of handle motion having a lateral motion component and a longitudinal motion component which feels comfortable or natural to a user moving his or her hands in an arcuate path. Still another apparatus used in chess press and seated row applications relies upon a geometry arranged so that hand grips of articulated arm assemblies follow arcuate paths which converge as the hand grips are moved forwardly. In this apparatus, movement of the hands towards one another as the exercise continues is said to be critical in maintaining a straight arm alignment of the elbow, wrist and hand of the arm, and to the uniform distribution of the lifting force of the shoulder joints of the user.

Notwithstanding the advancements the aforementioned exercise machines have contributed to the art, there remains an unperfected need to provide an upper torso machine having minimal unnatural motion or positioning of the shoulder as well as the elbow and wrist joints. It is also desirable to provide an exercise machine wherein there is no apparent abnormal rotation of the shoulder joint over the entire range of motion of the exercise, while simultaneously providing a full range of motion of the upper torso muscles involved in the exercise. It is further desirable to provide an exercise machine utilizing straight lever arms with handles movable over arcuate planes in which the handles are moved relative to each other as the exercise progresses and provide a degree of rotation which is less stressful to the joints.

BRIEF SUMMARY OF THE INVENTION

It is one object of the present invention to provide an improved method and apparatus for the exercise of an upper torso of a person.

It is a further object of the present invention to provide a carriage arrangement for defining an exercise path which will enable full resistance over an entire range of exercise motion with a minimum of stress on the shoulder, elbow and wrist joints.

It is also an object of the present invention to provide a shoulder press machine which effectively and safely exercises the deltoids, pectoral muscles and triceps.

Still another object of the present invention is to provide a low lat pull machine employing a motion translation arrangement as applied to the shoulder press machine.

Yet another object of the present invention is to provide an exercise machine which offers a degree of supination or pronation.

In one aspect of the invention, a shoulder press machine having a variable resistance provided therein includes a frame and a seat mounted to the frame. A motion translation arrangement is pivotally mounted to the frame about at least one horizontal axis defining a pair of spaced, parallel, angularly oriented pivot axes lying perpendicular to the horizontal axis. A pair of lever arms is movable against the variable resistance, each of the lever arms having a rearward end pivotally connected to the carriage about one of the pivot axes, and a downwardly extending, outwardly diverging forward end having an inwardly extending handle. The motion translation arrangement is constructed and arranged to provide a shoulder exercise motion for an exerciser occupied in the seat wherein the handles are moved in curved planes from a first location spaced laterally from a vertical plane bisecting the exercise machine to a second location substantially upwardly, rearwardly and inwardly from the first location at which the handles are slightly rotated. The variable resistance is preferably a weight plate removably connected to each of the lever arms.

In another aspect of the invention, an exercise machine includes a frame, and a seat adjustably mounted on the frame. A carriage is pivotally mounted to the frame about a first horizontal axis and a second horizontal axis parallel to, behind and above the first horizontal axis. The carriage defines a pair of spaced, parallel, angularly oriented pivot axes lying perpendicular to the first and second horizontal axes. The exercise machine also includes a pair of lever arms, each having one end pivotally connected to the carriage at one of the angularly oriented pivot axes, and another end provided with a handle. A structure is also provided for resisting movement of the lever arms. Movement of the lever arms and the carriage against the resisting structure and about the first horizontal axis will be translated into lateral motion of the lever arm about the pivot axes such that each of the handles will move in curved planes from a first location spaced laterally from a vertical plane bisecting the exercise machine to a second location substantially rearwardly and inwardly from the first location. The seat is adapted to support an exerciser in a declined seat position straddling the vertical plane. Each of the lever arms is provided with at least one laterally extending spindle for supporting at least one weight plate thereon. The carriage further includes an upper horizontal member and a lower horizontal member, and a pair of rigid mounting arms, each of the mounting arms being attached to the one end of the lever arm and extending laterally and outwardly relative to the lever arm. An initial starting position for each lever arm is about 25° from horizontal. The carriage further includes a pair of transfer links, each transfer link having a first end joined by a spherical bearing to one of the mounting arms, and a second end rotatably mounted to the frame about the second horizontal axis.

In yet another aspect of the invention, an exercise machine having a frame, a seat mounted on the frame and a pair of lever arms pivotally mounted relative to the frame has an improvement residing in a carriage pivotally mounted to the frame about a major horizontal axis and a minor horizontal axis located substantially parallel to the major horizontal axis. The carriage defines a pair of spaced, parallel, angularly oriented pivot axes lying perpendicular to the major and minor horizontal axes, and having a pair of transfer linkages, each linkage being rigidly connected at one end to one of the lever arms and pivotally connected at another end to the frame about the minor horizontal axis. The exercise machine is preferably in the form of a shoulder press machine or a low lat pull machine. Each transfer linkage is comprised of a rigid mounting arm connected to one of the lever arms, and a transfer link extending rearwardly of the mounting arm and being connected between the mounting arm and the frame. The major horizontal axis passes through a shaft rotatably supported in a pair of primary pillow block bearings mounted on the frame. Each pivot axis passes through a shaft rotatably supported in a set of secondary pillow block bearings mounted on the carriage. The minor horizontal axis passes through a shaft about which the transfer link is rotatable.

Still yet another aspect of the invention relates to an exercise machine including a stationary frame and a seat mounted to the frame. A pair of lever arms is pivotally connected relative to the frame, each of the lever arms having a rearward end and a forward end provided with a handle. A carriage is pivotally mounted to the frame about a first horizontal axis and defines a first pair of spaced, parallel, angularly oriented pivot axes lying perpendicular to the first horizontal axis about which pivot axes the rearward ends of the lever arms are swung inwardly and outwardly relative to the seat. The carriage includes a pair of laterally extending rigid mounting arms, each having a proximal end connected to a rearward end of one of the lever arms and a distal end. The carriage further includes a pair of transfer links, each having a first end joined in a swivel connection to one of the distal ends of the mounting arms, and a second end pivotally attached to the frame about a second horizontal axis substantially parallel to the first horizontal axis. The handle extends inwardly and then downwardly from the forward end of each lever arm. The swivel connection is comprised of a spherical bearing, and the second ends of the transfer links include sleeves rotatable about a second pair of angularly oriented pivot axes lying perpendicular to the horizontal axis.

Various other objects, features and advantages of the invention will be made apparent from the following description taken together with the drawings.

BRIEF DESCRIPTION OF THE SEVERAL VIEWS OF THE DRAWINGS

The drawings illustrate the best mode presently contemplated of carrying out the invention. In the drawings.

DETAILED DESCRIPTION OF THE INVENTION

Figure 5:
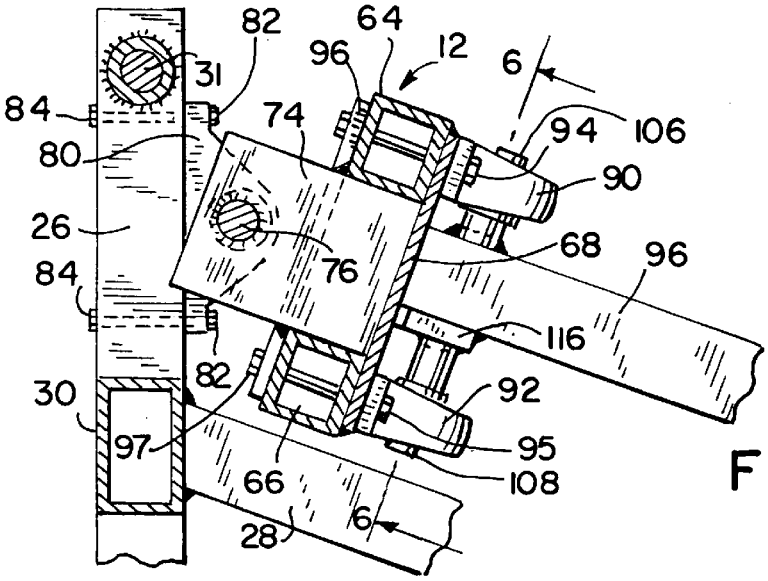
FIG. 5 is a partial sectional view taken on line 5—5 of FIG. 4.

FIGS. 1–4 illustrate a shoulder press machine 10 provided with a motion translation arrangement 12 embodying the present invention. The machine 10 includes a frame 14 constructed of a series of straight sections of heavy-duty, tubular steel which are welded together. In particular, the frame 14 comprises a base member 16 connected to a front transverse member 18 and a rear transverse member 20 which lend stability to the apparatus. In the preferred embodiment, the lengths of the members 16, 18 and 20 are 30 inches, 20 inches and 38 inches, respectively. These dimensions establish a reasonably sized footprint which reflects the space efficiency of the machine 10. A front leg 22 rises upwardly and rearwardly from the center of the front transverse member 18, and a pair of spaced, parallel rear uprights 24, 26 extend substantially vertically and perpendicularly from the rear transverse member 20. An angular brace 28 connects the front leg 22 with a short cross-member 30 (FIG. 5) joining the uprights 24, 26. Connecting the top of the uprights 24, 26 together is a horizontally disposed cylindrical tube 31.

On each side of the uprights 24, 26 is a downwardly and outwardly extending gusset 32, 34, respectively, which is welded between a respective upright 24, 26 and one end of the rear transverse member 20. Each of the gussets 32, 34 is provided with a pair of outwardly projecting, cylindrical spindles 36 which serve to support removable weight plates shown in phantom lines of FIG. 1. Connected across the angular brace 28 behind the front leg 22 and generally parallel to the front and rear transverse members 18, 20 is a lever arm support member 38. The frame 14 is supported at its corners by welded bottom plates 40, 42, 44, 46 which may be apertured to facilitate securement of the machine 10 to a supporting surface 48, such as a gym or home floor.

The bottom portion of the front leg 22 has a forwardly extending tongue 50 having a hollow tubular member 52 connected substantially perpendicularly thereto. The tubular member 52 carries a spring set, positioning pin 54 which provides for the upward and downward adjustability of a seat 56 having a downwardly projecting tubular support post 58. Appropriately aligned openings 59 (FIG. 1) formed in the tubular member 58 receive the positioning pin 54. The seat 56 is adapted to be positioned at various heights so as to provide a comfortable starting position for an exerciser and allow a full range of motion for a user of varying stature. A backrest 60 is joined to the angularly disposed front leg 22 above the seat 56 so that during exercise one occupies a sedentary position in a partially reclined orientation. The seat 56 and backrest 60 combine to create a support system for ensuring the comfort of a user during exercising. Typically, the seat 56 is declined rearwardly at an angle of about 10° from horizontal, while the backrest 60 is disposed at an angle of about 10° from vertical. The seat 56 and the backrest 60 are bisected by a vertical plane 62, FIG. 3, which essentially divides the machine 10 into two symmetrical halves.

In accordance with the invention, the motion translation arrangement 12 provides that an exerciser may move his or her hands from a first position spaced laterally from the vertical plane 62 to a second location (shown in phantom lines of FIG. 4) substantially upwardly, rearwardly and inwardly from the first location. During the course of this motion, an exerciser's hands are slightly rotated, or supinated, so that the machine 10 more easily accommodates the natural musculoskeletal make-up of the body without stress to the shoulder, elbow or wrist joints.

Figure 4A:
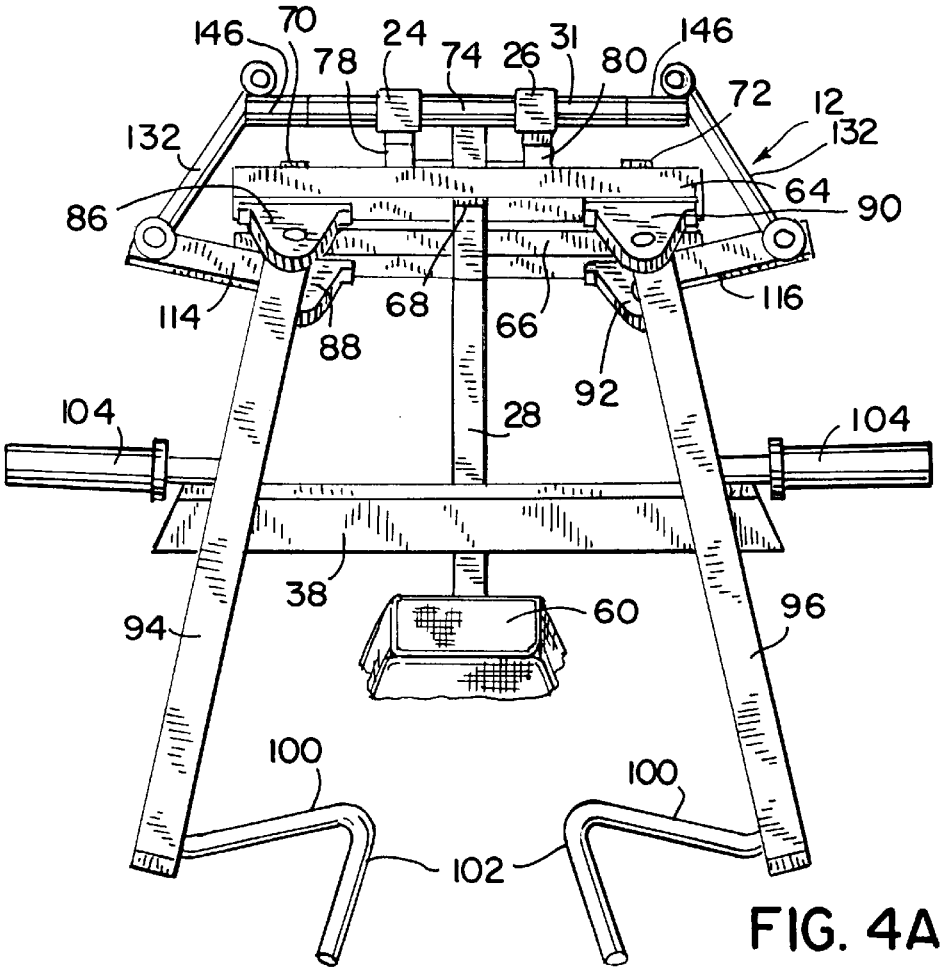
FIG. 4*a* is a fragmentary view similar to FIG. 4, but showing the lever arms in full lines moved to the uppermost position.

In the preferred embodiment, the motion translation arrangement 12 takes the form of a rotatable carriage having an upper horizontal tubular member 64 and a lower horizontal tubular member 66 held together on a front side thereof by a central connector plate 68 and on a rear side thereof by a pair of end connector plates 70, 72 (FIG. 4A). Extending rearwardly from the center of the carriage 12 is a connector block 74 carrying a cylindrical shaft 76 which is pivotable about a major horizontal axis A (FIG. 4) coaxial with the longitudinal axis of the shaft 76. The ends of the shaft 76 are pivotally mounted in a pair of spaced left and right hand pillow block bearings 78, 80 which are each vertically affixed to the upper, forward portion of the uprights 24, 26, respectively, by bolts 82 and nuts 84. By the above-described structure, the entire carriage 12 is rotatable about the major horizontal axis A.

Figure 2:
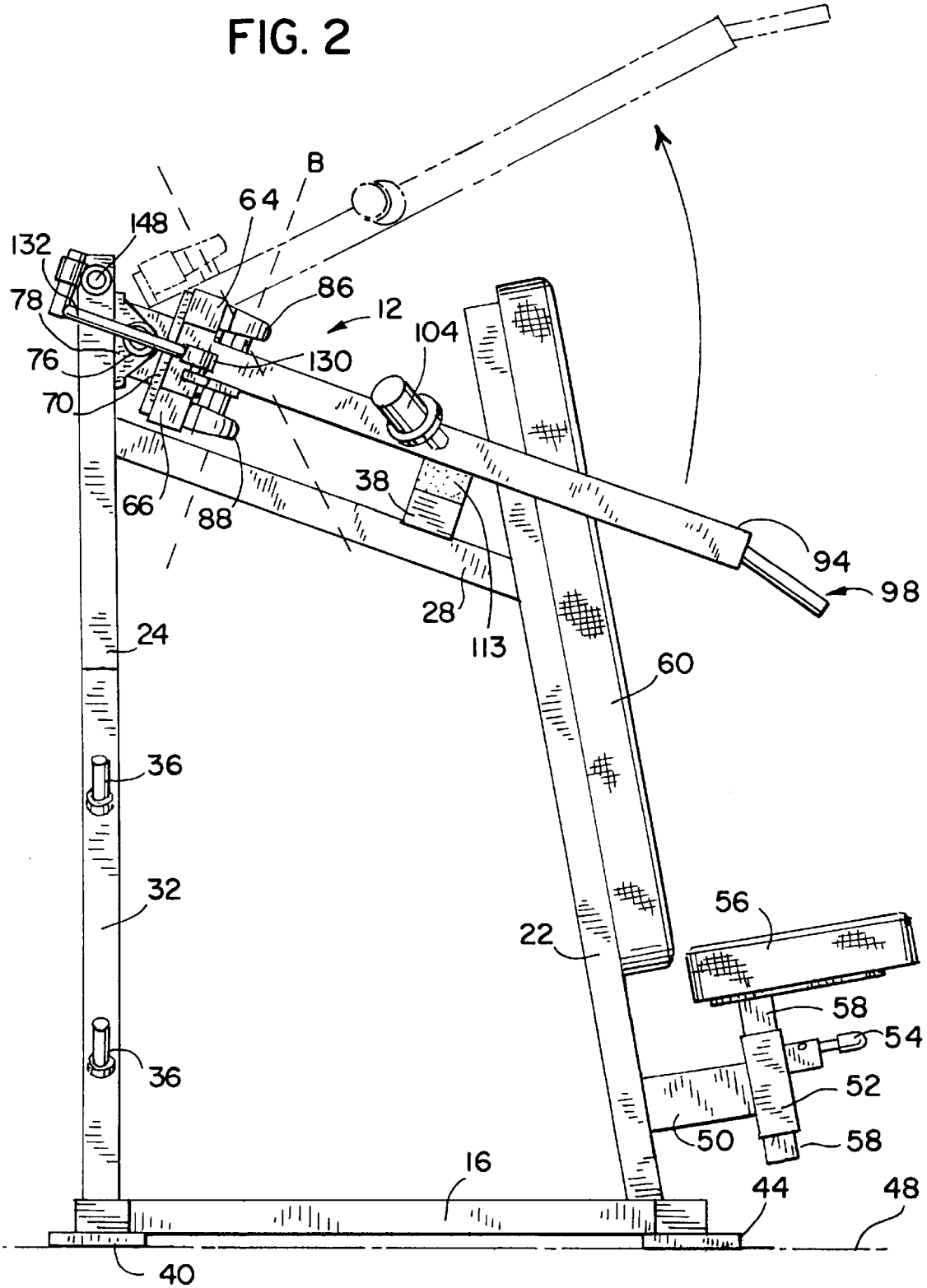
FIG. 2 is an elevational view taken from the left side of the shoulder press machine shown in FIG. 1, and showing, in phantom lines, an uppermost position of a pair of lever arms.
Figure 3A:
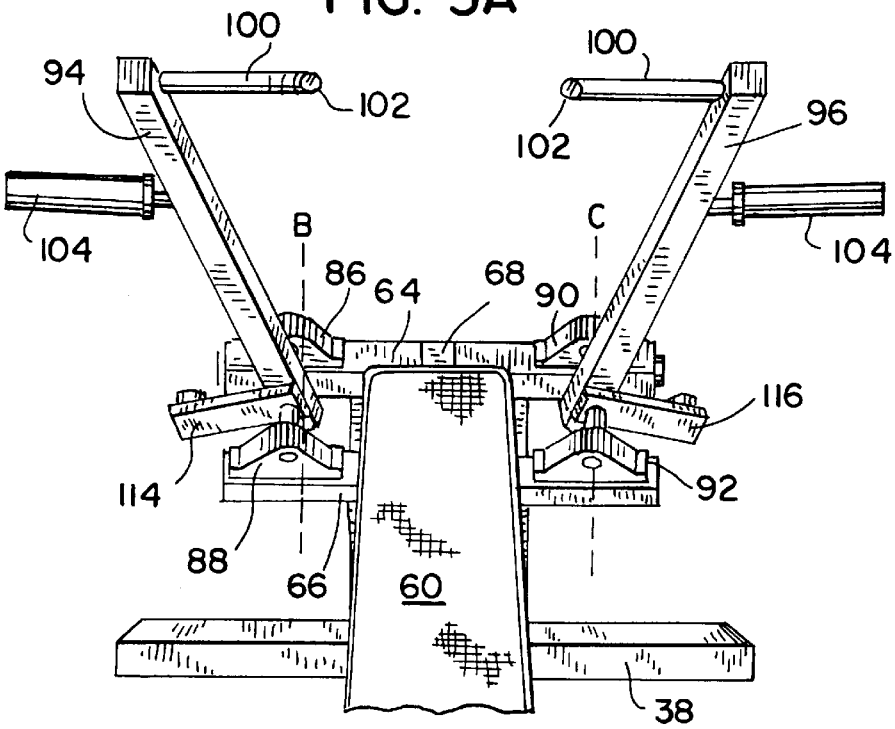
FIG. 3*a* is a fragmentary view similar to FIG. 3 showing the lever arms raised to the uppermost position.
Figure 3:
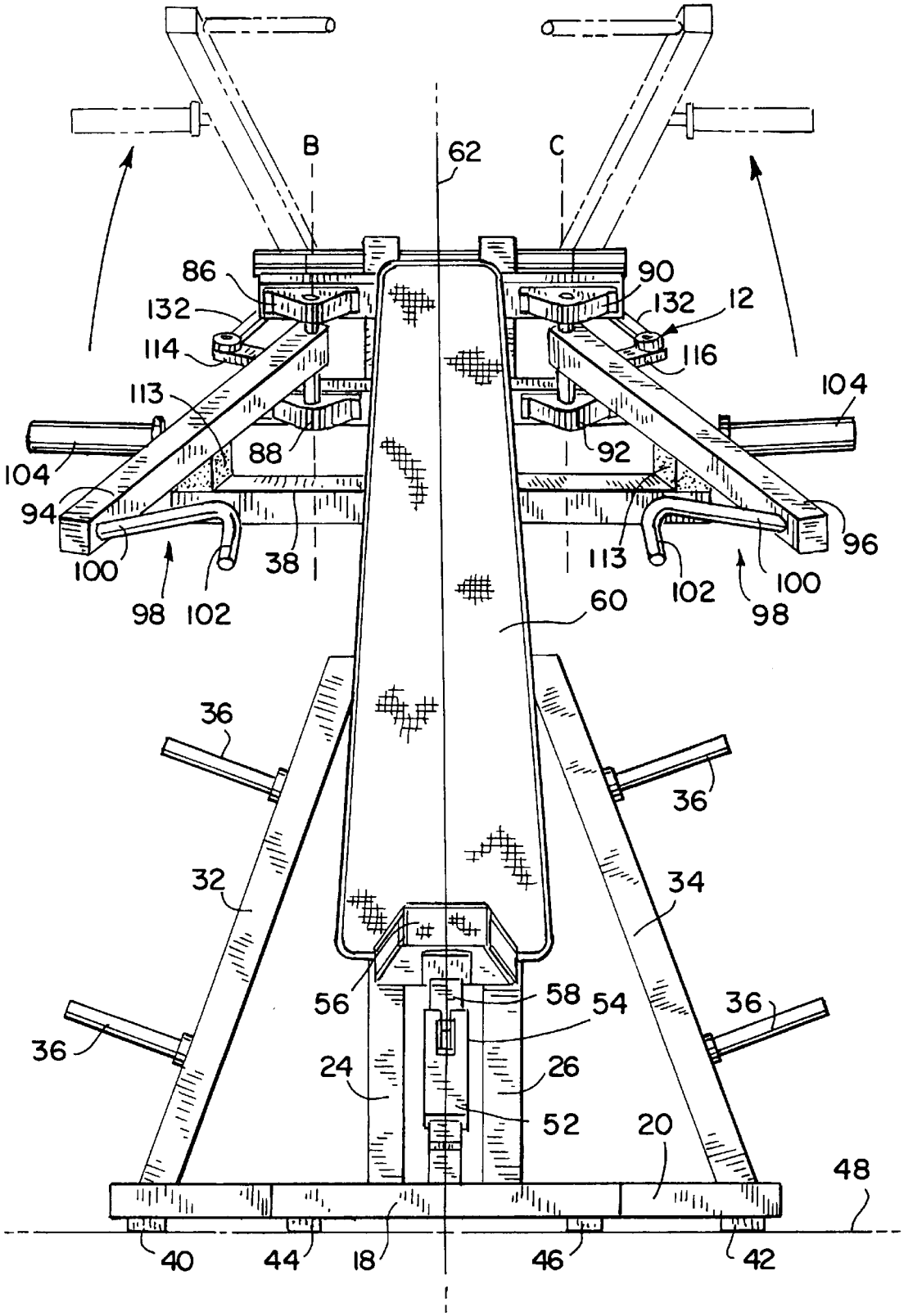
FIG. 3 is a front elevational view of the shoulder press machine shown in FIG. 2.

Attached on each side of central connector plate 68 to the forward side of the carriage 12 is a left hand set of pillow block bearings 86, 88 and a right hand set of pillow-block bearings 90, 92 which are anchored to the upper and lower horizontal tubular members 64, 66 by nuts 95 and bolts 97. Each set of pillow block bearings 86, 88 and 90, 92 define the location of a pair of spaced, pivot axes B, C (FIGS. 3, 3A) about which a pair of lever arms 94, 96 swing inwardly and outwardly relative to backrest 60. As seen best in FIGS. 2 and 3, the pivot axes B, C are disposed generally perpendicularly to the longitudinal axis of shaft (i.e. the major horizontal axis A) and are angularly oriented with respect to a plane passing through the uprights 24, 26. Each lever arm 94, 96 is a straight, non-articulated member which extends downwardly and diverges outwardly relative to the carriage 12. A forward end of each lever arm 94, 96 includes a rubber covered, bent handle 98 having an inwardly extending portion 100 and an outwardly extending portion 102 with respect to backrest 60. The handles 98 present a natural gripping position for the hands of an exerciser as they move through curved planes to be explained hereafter. A mid-portion of each lever arm 94, 96 is provided with a laterally outwardly and upwardly extending support spindle 104 for holding one or more removable weight plates (shown in phantom in FIG. 1) that define a variable resistance against which the lever arms 94, 96 are moved. It should be understood that while the invention preferably depicts removable weight plates, the machine 10 can be modified to include a cable and weight stack system or any other variable resistance commonly used in the art. A rearward end of each lever arm 94, 96 includes a stub shaft 105 having an upper end 106 and a lower end 108 which are rotatable in bearings 110, 112 along the pivot axes B, C. Each lever arm 94, 96 preferably has a length of 34 inches and is oriented downwardly in a rest position at an initial angle of about 25° from the horizontal as shown in FIG. 2. In order to limit their downward extent, each arm 94, 96 coacts with a rubber block 113 (FIG. 3) mounted at the ends of angular brace 28.

Figure 2A:
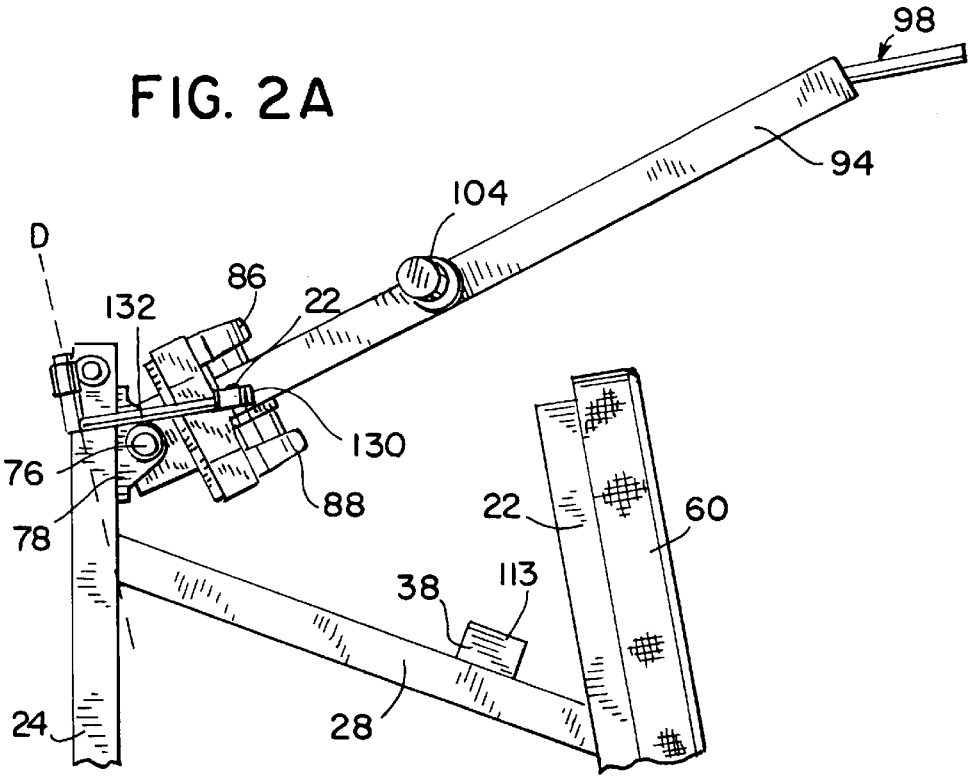
FIG. 2*a* is a fragmentary view similar to FIG. 2 showing the lever arms in full lines moved to their uppermost position.
Figure 6:
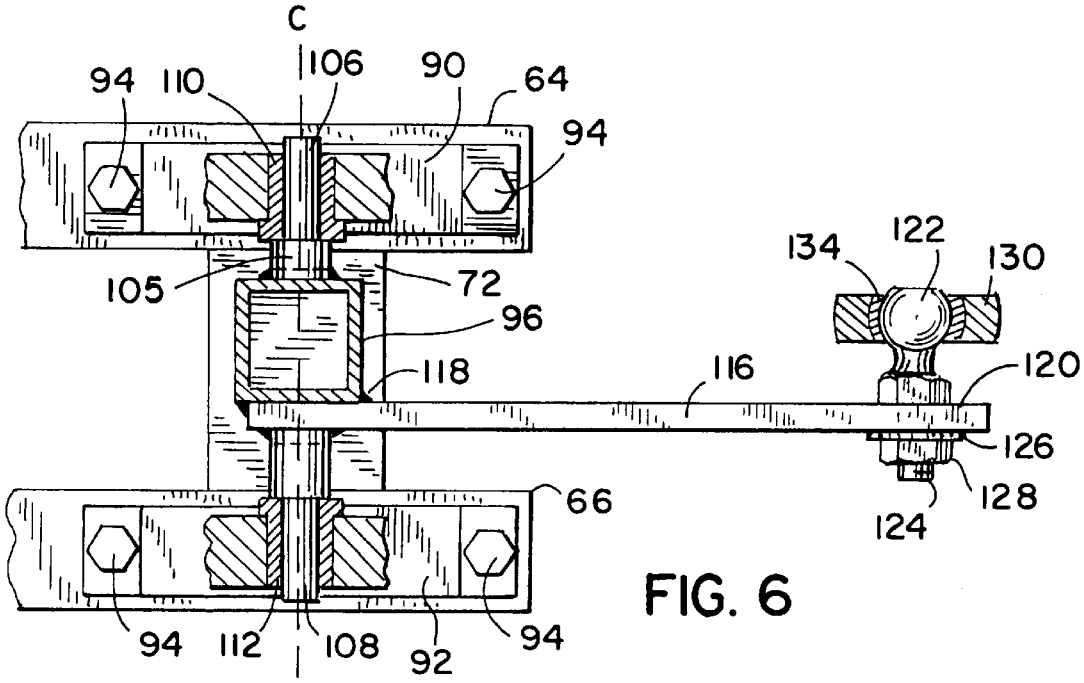
FIG. 6 is a partial sectional view taken on line 6—6 of FIG. 5.
Figure 4:
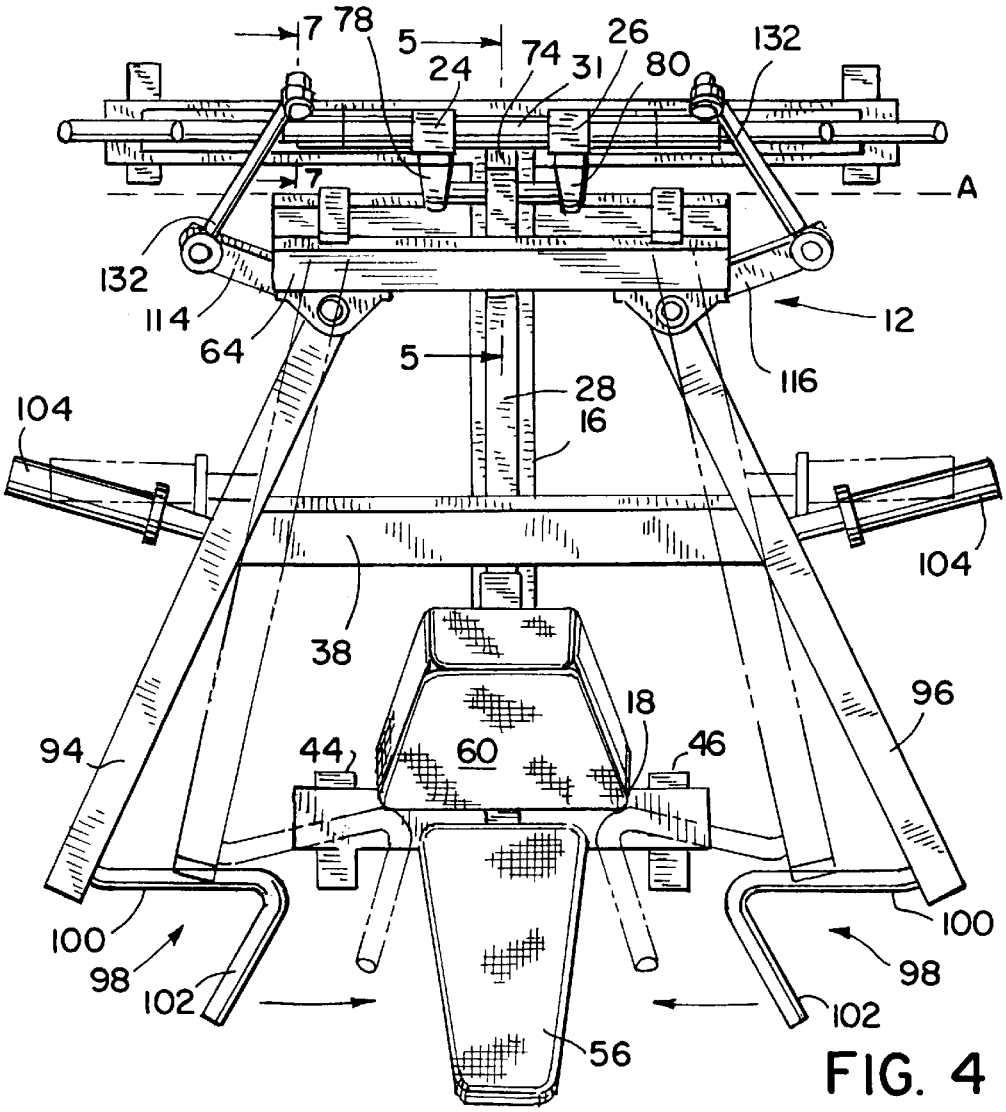
FIG. 4 is a plan view of the shoulder press machine shown in FIG. 1, showing in phantom lines the inward and outward motion of the lever arms.

Carriage 12 further includes a pair of rigid, plate-like mounting arms 114, 116 which extend outwardly and rearwardly relative to the horizontal tubular members 64, 66. As shown in FIG. 6, each mounting arm 114, 116 has a proximal end 118 which is welded to the rearward end of each lever arm 94, 96 and a distal end 120 having a spherical ball joint 122 with a threaded bottom portion 124 which passes through a suitable hole formed in the distal end 120 and is connected by a washer 126 and nut 128. A forward end 130 of an L-shaped transfer link 132 movably connected to each mounting arm 114, 116 has a bearing 134 which swivels about the ball joint 122 as the carriage 12 is rotated about the axis of shaft 76 or the major horizontal axis A best appreciated in FIGS. 2, 2A.

Figure 1:
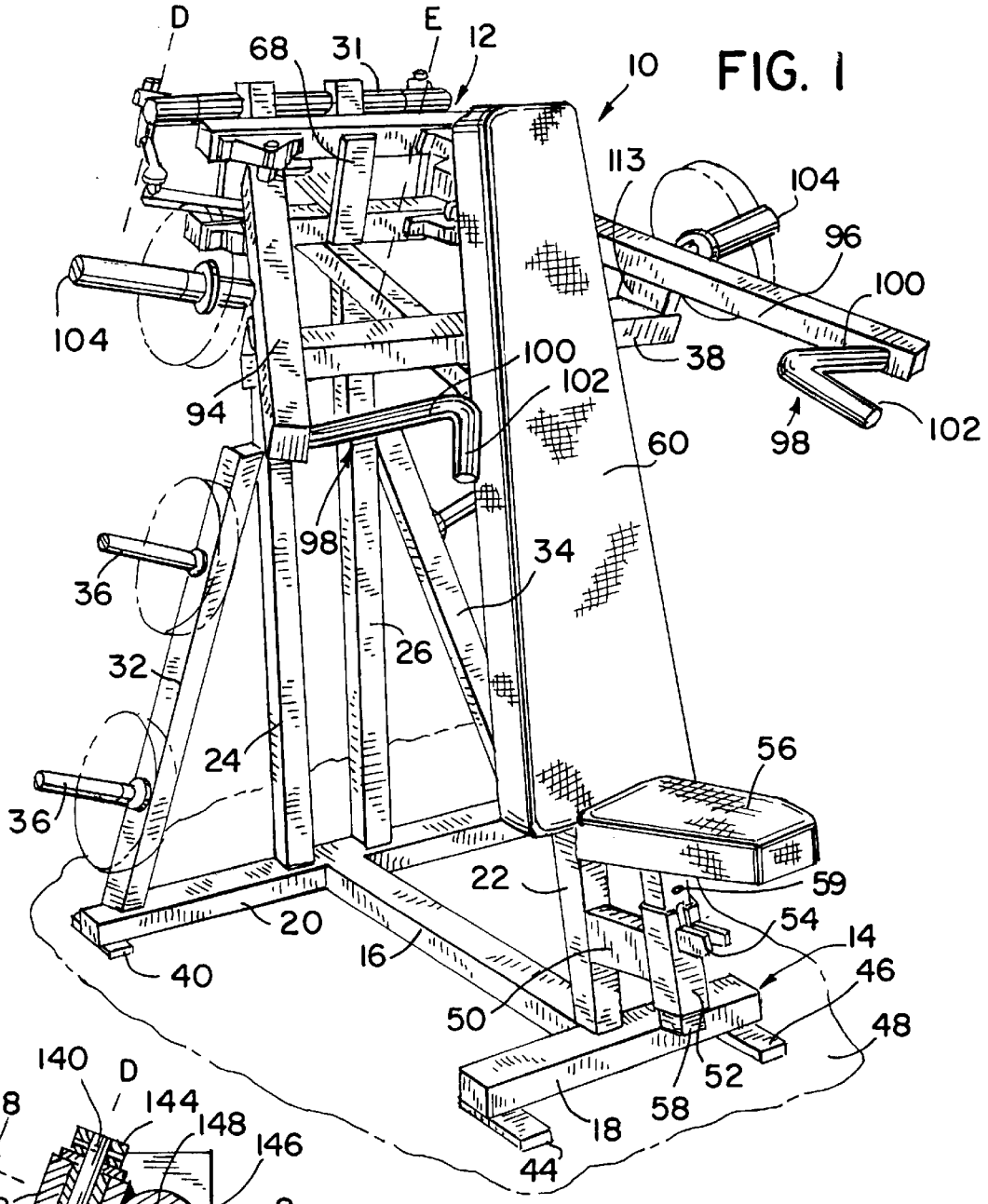
FIG. 1 is a perspective view of a plate-loaded shoulder press machine embodying the present invention.
Figure 7:
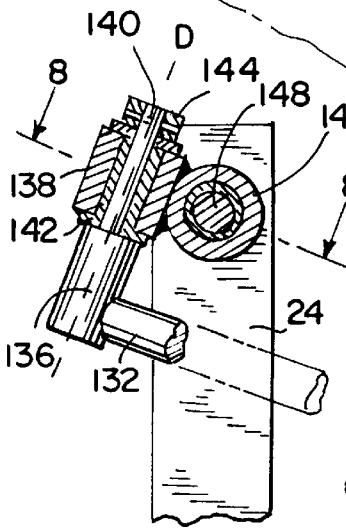
FIG. 7 is a partial sectional view taken on line 7—7 of FIG. 4.
Figure 8:
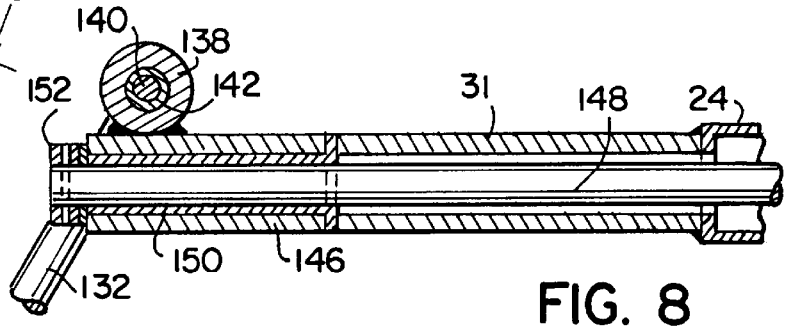
FIG. 8 is a partial sectional view taken on line 8—8 of FIG. 7.

FIGS. 7 and 8 show the structure of a rearward end 136 of each transfer link 132 which includes a sleeve 138 rotatable about a rod portion 140 via a bearing 142. The end of rod portion 140 includes a protective cap 144. Each of the rods 140 define a second set of angularly oriented pivot axes D, E (FIG. 1) about which the transfer links 132 may pivot. Each of the sleeves 138, in turn, is welded to a horizontally disposed sleeve 146 rotatable about an elongated shaft 148 passing through fixed tube 31 via a bearing 150. The end of shaft 148 is provided with a protective cap 152. The longitudinal axis of shaft 148 defines a minor or second horizontal axis about which carriage 12 also rotates. The axis F is parallel to, behind and above the major horizontal axis A (the axis of shaft 76). Together the mounting arms 114, 116 and the transfer links 132 create a pair of transfer linkages, each being rigidly connected at one end of the lever arms 94, 96, and pivotally connected at the other end to the frame 14 about the minor horizontal axis F.

In use, one or more weight plates (shown in phantom in FIG. 1) are transferred from the weight spindles 36 on gussets 32, 34 to the spindles 104 on lever arms 94, 96. The exerciser adjusts the seat 56 to a suitable position along the support post 58 so the handles 98 lie at the proper vertical height relative to the shoulders. The exerciser than grasps the handles 98 preferably along their downward portion 102 and pushes upwardly causing both lever arms 94, 96 to pivot upwardly from the rest position of FIGS. 2 and 3 about the major horizontal axis A (longitudinal axis of shaft 76). As the lever arms 94, 96 continue to move upwardly, they will swing inwardly about angular pivot axes B, C as shown in FIGS. 3, 3A, 4, 4A according to the movement of transfer linkages 114, 116, 132 including the swivel connection defined by the spherical ball joint 122 and bearing 134, and the rotation of sleeves 138, 146 about axes D and F, respectively. As a result, the lever arms 94, 96 move in curved planes shown in FIG. 3 and assume a completed shoulder press movement shown in solid lines of FIG. 4. FIG. 2 shows the lever arms 94, 96 are generally pivoted upwardly about 25° to 30° from horizontal. This of course depends on such functions such as the torso and limb lengths of the exerciser. Here, the handles 98 have not only moved upwardly, rearwardly and inwardly from their spaced initial position on either side of the vertical plane 62 bisecting the machine 10, but they have also rotated slightly inward about 20° or 30°, or in this case supinated, to achieve a high degree of isolated shoulder exercise over a full range of motion with maximum accommodation to the exerciser's musculoskeletal structure. Otherwise stated, the carriage is able to provide an extremely natural path of exercise with minimum stress to the joints of the shoulder, wrist and elbow.

Figure 9:
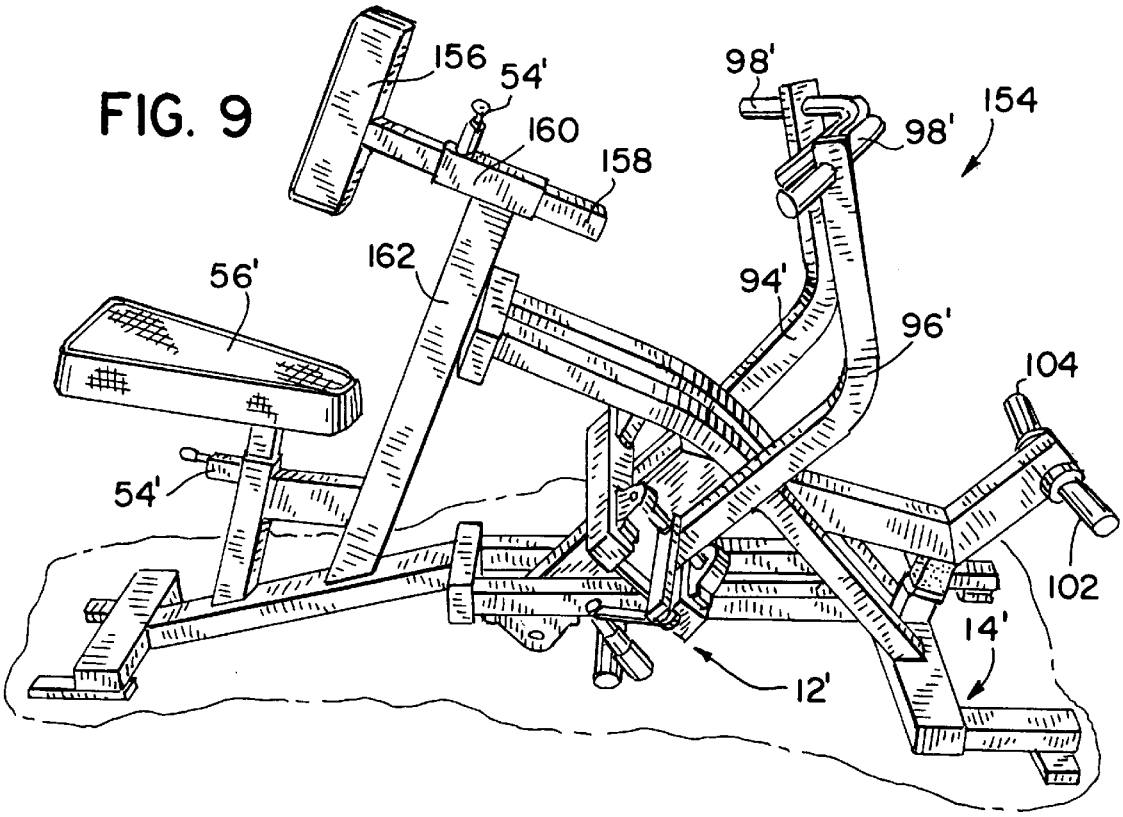
FIG. 9 is an elevational view of a low lat pull machine embodying the present invention.
Figure 10:
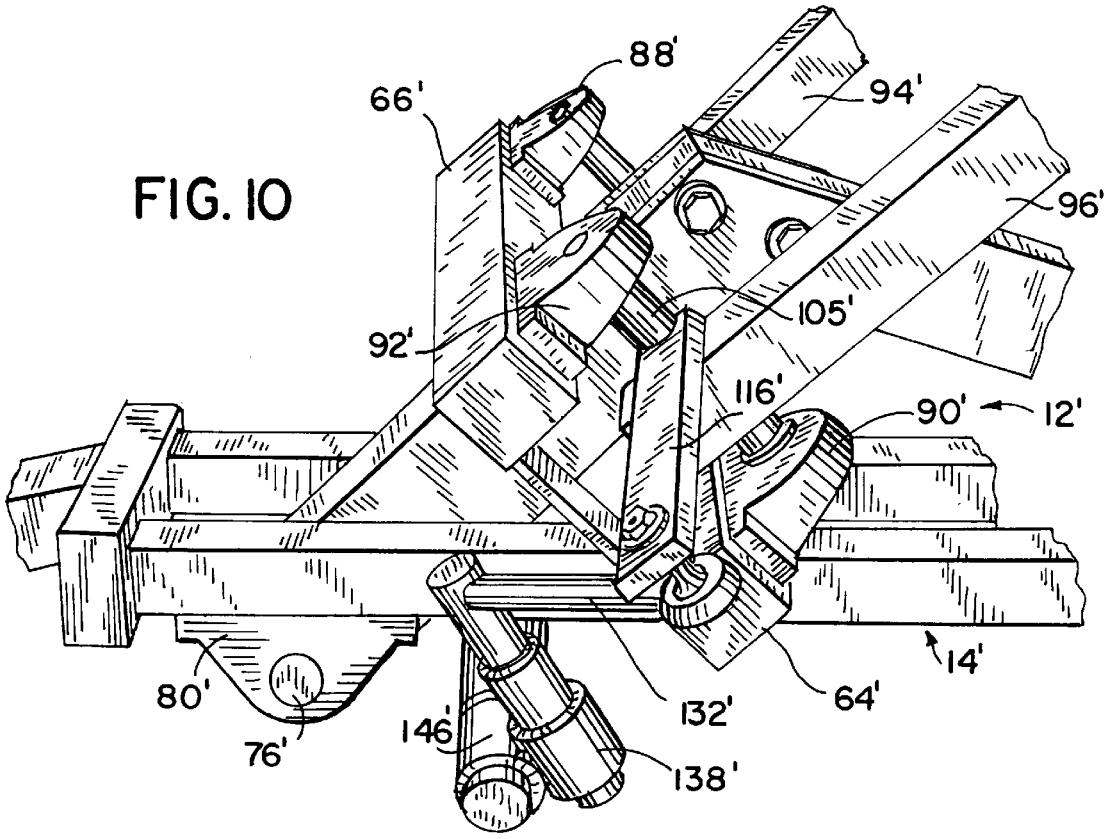
FIG. 10 is an enlarged elevational view of a portion of the low lat pull machine of FIG. 9 embodying the present invention.

FIGS. 9 and 10 illustrate the use of a carriage 12' on a low lat pull machine 154. Like numerals denote like elements previously discussed so that carriage 12' is similar to carriage 12. A cushion 156 is provided in front of the exerciser's chest for support during the low lat pull. The cushion 156 has a support post 158 which is adjustable in a tubular member 160 connected at the top of an angular member 162. A spring or pop-in pin selector like selector 54' aligns a pin with a hole formed in the support post 158 to select the desired protection. In the machine, the exerciser loads weight plates (not shown) on spindles 104' and then proceeds to pull handles 98' rearwardly from a closely spaced initial forward position to a widely spaced final or rear position on the other side of the cushion 156 at which the handles 98' are slightly rotated or pronated. In other words, the carriage 12' is used to give a reverse effect from the shoulder press application. However, the carriage 12' translates motion in a similar fashion as carriage 12, there being a difference in the lengths of certain components such as mounting arm 116'.

It should be understood that the present invention provides a motion translation arrangement for an exercise machine which can effectively exercise the upper torso without subjecting the shoulder joint to undue stress. The present invention provides the advantages of dumbbell exercise in a safe, effective and controlled manner. The machine of the present invention may be used to maintain and develop muscles as well as rehabilitate an injured body part by closely controlling the variable resistance imposed on the lever arms.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

We claim:

1. A shoulder exercise machine having a variable resistance provided therein, the machine comprising:

a frame;

a seat mounted to the frame;

a backrest attached to the frame rearwardly of the seat;

a motion translation arrangement pivotally mounted to the frame about at least one horizontal axis, and defining a pair of spaced, parallel, angularly oriented pivot axes lying perpendicular to the horizontal axis;

a pair of lever arms movable against the variable resistance, each of the lever arms having a rearward end pivotally connected to the motion translation arrangement about one of the pivot axes, and a downwardly extending, outwardly diverging forward end having an inwardly extending handle, and the motion translation arrangement including means to compel each lever arm to converge by pivoting about a respective pivot axis as the motion translation arrangement is pivoted about the at least one horizontal axis, the motion translation arrangement constructed and arranged to provide a shoulder exercise motion for an exerciser occupied in the seat wherein the handles are moved in curved planes from a first location spaced laterally from a vertical plane bisecting the exercise machine to a second location substantially upwardly, rearwardly and inwardly from the first location at which second location the handles are slightly rotated.

2. The shoulder exercise machine of claim 1, wherein the variable resistance is a weight plate removably connected to at least one of the lever arms.

3. The shoulder exercise machine of claim 1, wherein each handle also extends downwardly.

4. An exercise machine comprising:

a frame;

a seat adjustably mounted on the frame;

a carriage pivotally mounted to the frame about a first horizontal axis and a second horizontal axis parallel to, behind and above the first horizontal axis, the carriage defining a pair of spaced, parallel, angularly oriented pivot axes lying perpendicular to the first and second horizontal axes;

a pair of lever arms, each having one end pivotally connected to the carriage at one of the angularly oriented pivot axes, and another end provided with a handle; and structure for resisting movement of the lever arms, wherein movement of the lever arms and the carriage against the resisting structure and about the first horizontal axis will be translated into lateral motion of the lever arms about the pivot axes such that each of the handles will move in curved planes from a first location spaced laterally from a vertical plane bisecting the exercise machine to a second location substantially rearwardly and inwardly from the first location.

5. The exercise machine of claim 4, wherein the seat is adapted to support an exerciser in a declined seated position straddling the vertical plane.

6. The exercise machine of claim 4, wherein each of the lever arms is provided with at least one laterally extending spindle for supporting at least one weight plate.

7. The exercise machine of claim 4, wherein the carriage further includes an upper horizontal member and a lower horizontal member.

8. The exercise machine of claim 4, wherein the carriage further includes a pair of rigid mounting arms, each of the mounting arms being attached to the one end of the lever arm, each of the mounting arms extending laterally and outwardly relative to the lever arm.

9. The exercise machine of claim 4, wherein an initial starting position for each lever arm is about 25° from horizontal.

10. The exercise machine of claim 8, wherein the carriage further includes a pair of transfer links, each transfer link having a first end joined by a spherical bearing to one of the mounting arms, and a second end rotatably mounted to the frame about the second horizontal axis.

11. In an exercise machine having a frame, a seat mounted on the frame and a pair of lever arms pivotally mounted relative to the frame, the improvement residing in:

a carriage pivotally mounted to the frame about a major horizontal axis and a minor horizontal axis located substantially parallel to the major horizontal axis, the carriage defining a pair of spaced, parallel, angularly oriented pivot axes lying perpendicular to the major and minor horizontal axes, and having a pair of transfer linkages, each linkage being rigidly connected at one end to one of the lever arms and pivotally connected at another end to the frame about the minor horizontal axis, wherein movement of the lever arms and the carriage about the major and minor horizontal axes will be translated into lateral motion of the lever arms about the pivot axes such that each lever arm moves in a curved path from a first location to a second location.

12. The exercise machine of claim 11, in the form of a shoulder press machine.

13. The exercise machine of claim 11, in the form of a low lat pull machine.

14. The exercise machine of claim 11, wherein each transfer linkage is comprised of a rigid mounting arm connected to one of the lever arms, and a transfer link extending rearwardly of the mounting arm and being connected between the mounting arm and the frame.

15. The exercise machine of claim 11, wherein the major horizontal axis passes through a shaft rotatably supported in a set of primary pillow block bearings mounted on the frame.

16. The exercise machine of claim 11, wherein each pivot axes passes through a shaft rotatably supported in a set of secondary pillow block bearings mounted on the carriage.

17. The exercise machine of claim 11, wherein the minor horizontal axes passes through a shaft about which the transfer link is rotatable.

18. An exercise machine comprising:

a stationary frame;

a seat mounted to the frame;

a pair of lever arms pivotally connected relative to the frame, each of the lever arms having a rearward end and a forward end provided with a handle; and a carriage pivotally mounted to the frame about a first horizontal axis and defining a first pair of spaced, parallel, angularly oriented pivot axes lying perpendicular to the first horizontal axis about which pivot axes the rearward ends of the lever arms are swung inwardly and outwardly relative to the seat, the carriage including a pair of laterally extending rigid mounting arms, each having a proximal end connected to a rearward end of one of the lever arms and a distal end, the carriage further including a pair of transfer links, each having a first end joined in a swivel connection to one of the distal ends of the mounting arms and a second end pivotally attached to the frame about a second horizontal axis substantially parallel to the first horizontal axis, wherein movement of the lever arms and carriage about the first and second horizontal axes will be translated into lateral motion of the lever arms about the pivot axes such that each of the handles will move in curved planes from a first location to a second location.

19. The exercise machine of claim 18, wherein the handle extends inwardly and then downwardly from the forward end of each lever arm.

20. The exercise machine of claim 18, wherein the swivel connection is comprised of a spherical bearing.

21. The exercise machine of claim 18, wherein the second ends of the transfer links include sleeves rotatable about a second pair of angularly oriented pivot axes lying perpendicular to the second horizontal axis.

* * * * *